US006528227B2

(12) United States Patent
Van den Zegel et al.

(10) Patent No.: US 6,528,227 B2
(45) Date of Patent: Mar. 4, 2003

(54) FILM/SCREEN SYSTEM AND IMAGE-FORMING SYSTEM FOR USE IN DIRECT X-RAY APPLICATIONS

(75) Inventors: Marc Van den Zegel, Boortmeerbeek (BE); Marleen De Vester, Broechem (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/955,674

(22) Filed: Sep. 19, 2001

(65) Prior Publication Data

US 2002/0076640 A1 Jun. 20, 2002

Related U.S. Application Data

(60) Provisional application No. 60/245,289, filed on Nov. 2, 2000.

(30) Foreign Application Priority Data

Oct. 4, 2000 (EP) ..... 00203440

(51) Int. Cl.[7] ..... G03C 1/035; G03C 1/36; G03C 3/00; G03C 5/17

(52) U.S. Cl. ..... 430/139; 430/396; 430/440; 430/567; 430/606; 430/942; 430/966; 430/967

(58) Field of Search ..... 430/567, 606, 430/966, 967, 942, 139, 440, 396

(56) References Cited

U.S. PATENT DOCUMENTS 5,900,357 A * 5/1999 Feumi-Jantou ..... 430/966
5,952,163 A * 9/1999 Baugher et al. ..... 430/606
5,965,337 A * 10/1999 Drain et al. ..... 430/966

* cited by examiner

*Primary Examiner*—Richard L. Schilling
(74) *Attorney, Agent, or Firm*—Joseph T. Guy; Nexsen Pruet Jacobs & Pollard, LLC

(57) ABSTRACT

A direct X-ray system for industrial radiography like non-destructive testing applications, and personal monitoring, being particularly less sensitive to pressure phenomena, has been disclosed, said system consisting of a direct X-ray black-and-white negative-working radiographic film material, comprised of a transparent support coated on at least one side thereof with a tabular grain emulsion layer, substantially free from spectrally sensitizing dyes, in which at least 50 percent of total grain projected area of all grains is accounted for by silver bromoiodide tabular grains having an iodide content of less than 5 mole %, based on silver, having an average aspect ratio of at least 2, and having a volume greater than 0.03 $\mu m^3$, further characterized in that said tabular grain emulsion layer(s) comprise(s), in an amount of from 5 mg up to 100 mg per mole of coated silver bromoiodide at least one desensitizing agent having a hetero-aromatic part and an electron-withdrawing group and (2) disposed on opposite sides of the radiographic element, two intensifying screen sheets selected from the group consisting of lead, lead oxide, copper and steel, said screen sheets having been designed in order to emit electrons when exposed to X- or $\gamma$-rays with an energy greater than or equal to 10 kVp.

11 Claims, No Drawings

FILM/SCREEN SYSTEM AND IMAGE-FORMING SYSTEM FOR USE IN DIRECT X-RAY APPLICATIONS

This application claims the benefit of Provisional Application No. 60/245,289, filed Nov. 2, 2000.

FIELD OF THE INVENTION

The present invention relates to a system suitable for use in direct X-ray applications as industrial non-destructive testing applications and personal monitoring, said system being comprised of a radiation-sensitive black-and-white silver halide photographic material in contact with screen sheets having been designed in order to emit electrons when exposed to X- or •-rays with an energy greater than or equal to 10 kVp.

BACKGROUND OF THE INVENTION

Industrial radiography is a non-destructive technique for testing and analyzing defects in components such as glass, paper, wood or metal parts, etc. This technique is widely used in aeronautics, the nuclear industry or the petroleum industry since it makes it possible to detect welding defects or defects in the texture of materials in aircraft components, nuclear reactors or pipelines. This technique consists of exposing a component to be analyzed to an ionizing radiation, in general X- or gamma rays having an energy between 10.000 and 15.000 kVp, either directly or by means of an intensifying screen. It is therefore necessary with this technique to use specific radiographic elements which are highly sensitive to this ionizing radiation. The major part of the ionizing radiation however passes through the silver halide grains without being absorbed and only a very small part of the incident radiation (less than 1%) is really absorbed and contributes to the formation of a developable latent image.

In order to really achieve high film sensitivity, also called "speed", which is an indispensible asset especially for direct-röntgen applications, efficient absorption of the exposure radiation is a prime condition. It has been shown empirically that for X-rays the mass absorption coefficient is proportional to a power of the atomic number Z as has been described in the "Encyclopaedic Dictionary of Physics" vol. 7, p. 787, eq. 10, Ed. J.Thewlis, Pergamom Press, Oxford 1957. This strongly favours the use of iodide(Z=54), more than bromide (Z=35) and further more than chloride (Z=17).

As a consequence silver bromo(chloro)iodide crystals have preferably been used hitherto. Absorption of the ionizing radiation can further be enhanced by increasing the silver content and/or the thickness of the emulsion layers. Moreover it is known to provide double-side coated materials in favour of absorption of high energy radiation.

Cubic silver bromoiodide grains have until now preferably been used in non-destructive testing applications for the reason set out above, preferably coated in high amounts of more than 20 g/m2, expressed as equivalent amounts of silver nitrate. Lowering of coated amounts of silver thus results in a reduction of sensitivity for direct-Röngten rays and further leads to a lowering in contrast, which may be in favour of image quality (especially graininess) as desired for some well-designed applications, but makes maximum density decrease to an unacceptable level. When in such case only use can be made of radiation sources for X-rays having a lower energy output (exposure energies of about 100 kVp instead of the normally used 220 kVp) besides undesired higher contrasts a reduced speed can be expected. Although said reduced speed can be compensated in industrial radiographic exposure techniques by application of intensifying screens in contact with industrial non-destructive test film materials, thereby taking profit of the combined effect of direct-Röntgen exposure and exposure by light emitted from light-emitting phosphors present in the intensifying screens, the problem of too high contrasts remains in that case.

A suitable solution therefor has been presented in EP-A 0 890 875 and the corresponding U.S. Pat. No. 6,030,757 wherein a multilayer arrangement has been disclosed for a material suitable for e.g. concrete testing and wherein use was made, besides the well-known cubic grain emulsions, from tabular grain emulsions. Applicability of tabular grains in nondestructive testing applications had already been proposed before in EP-A 0 757 286 and the corresponding U.S. Pat. No. 5,965,337, moreover providing an improved speed.

As had indeed been made clear in the earliest patents about practical materials coated from tabular grain emulsions, such as in U.S. Pat. No. 4,414,304 with tabular grains having an aspect ratio of at least 5:1 and, more particularly, an average grain thickness of less than 0.20 $\mu$m, a high covering power can be provided, even when the gelatinous coating layers of the material have been strongly prehardened. An increase in covering power in the presence of such tabular grains, if compared with more compact grains such as cubic grains having the same volume, can be translated into a decrease in coated amounts of silver halide, in order to reach the same maximum density. One of the disadvantages reflected by the presence of thin tabular grains however, when present in an industrial photographic material for nondestructive testing, which is often manipulated without taking precautions as has been described in Example 4 of EP-A 0 757 286, is its pressure sensitivity (also called "kink" therein). When the emulsions comprised AgBr(I) tabular grains with an iodide peak, the kink was improved as set forth. Example 4.2 e.g. comprises bromoiodide (1% iodide) tabular grains prepared according to the above described preparation process (iodide was added in one step after having added 64% of the total silver amount).

Presence of iodide in higher concentrations in the outermost layers of silver halide emulsion grains may however lay burden on the developability of the grains and also fixation times may increase, which results in a longer processing time or in a decrease in image quality if processing times are left unchanged.

OBJECTS OF THE INVENTION

It has been an object of the present invention to provide a direct X-ray system having silver halide photographic film materials for industrial non-destructive testing applications and personal monitoring, said system offering high speed after rapid processing of said film materials, being exposed to high-energy radiation exposure by X-ray of •-ray sources, as e.g. from a Co-60 source, and a method in order to provide images having high image quality, with a high diagnostic value, i.a., without disturbing kinks due to pressure sensitization.

Other objects will become apparent from the description hereinafter.

SUMMARY OF THE INVENTION

In order to reach the objects as set forth, a direct X-ray system has been provided, said system being comprised of (1) a black-and-white negative-working radiographic film material, more particularly used as non-destructive testing material, comprised of a transparent support coated on at least one side thereof with a tabular grain emulsion layer, substantially free from spectrally sensitizing dyes, in which at least 50 percent of total grain projected area of all grains is accounted for by silver bromoiodide tabular grains having an iodide content of less than 5 mole %, based on silver, further having an average aspect ratio of at least 2, and having a volume greater than 0.03 $\mu m^3$, characterized in that said tabular grain emulsion layer(s) comprise(s), in an amount of from 5 mg up to 100 mg per mole of coated silver bromoiodide at least one desensitizing agent having a hetero-aromatic part and an electron-withdrawing group;

(2) disposed on opposite sides of the radiographic element, two intensifying screen sheets selected from the group consisting of lead, lead oxide, copper and steel, said screen sheets being designed to emit electrons when exposed to X- or γ-rays with an energy greater than or equal to 10 kVp.

An image-forming method in order to form an industrial radiographic image has also been claimed, said method comprising the steps of exposing a system as set forth hereinbefore to X- or γ-rays with an energy greater than or equal to 10 kVp in order to form a latent image in radiation-sensitive layers of the film material, and developing the said latent image.

A personal electromagnetic radiation monitor wearable by a person in order to warn the person of a radiation hazard condition caused by electromagnetic radiation emanating from a source of electromagnetic radiation has further been claimed, said monitor essentially comprising a material according to the material suitable for use in the system according to the present invention set forth above.

DETAILED DESCRIPTION OF THE INVENTION

It is well-known by anyone skilled in the art of photography that commonly a "desensitizer" is used in emulsions in order to reduce the sensitivity of that emulsion to light exposures, as e.g. for surface fogged direct positive emulsions by trapping surface electrons, thereby desensitizing surface latent image forming emulsions. It is further well-known that conventional desensitizers employed in photography and, occasionally, in indirect radiography (making use of intensifying screens having luminescent phosphors that emit light after having been exposed to X-rays, wherein said light further exposes the silver halide emulsion grains in the film material), do not reduce the absorption of X-radiation and hence do not reduce the sensitivity of the emulsions to X-radiation exposures.

In the present invention it has unexpectedly been found that a solution for the pressure sensitivity of a tabular grain emulsion layer in a direct X-ray film material as, more particularly, an industrial black-and-white negative-working radiographic film material could be provided, making use therefor, in an amount of from 5 mg up to 100 mg per mole of coated silver bromoiodide, of at least one desensitizing agent having a hetero-aromatic part and an electron-withdrawing group in its structure.

In a preferred embodiment according to the present invention a material is provided wherein said at least one hetero-aromatic part in the desensitizing agent or compound is selected from the group consisting of benzo-selenazole; benzo-thiazole; 1-cyclohexylpyrrole; 1,2-diaryl-indole; pyrrolo-[2,3-b]pyrazine; pyrrolo [2,3-b]pyridine; pyrrolo[2,3-b]quinoxa-line; imidazo[4,5-b]quinoxaline; imidazo[1,2-b]pyridazine; quinolinium; imidazo[2,1-b]-1,3,4-thiadiazole; imidazo[2,1-b]-thia-zole; imidazo[1,2-a]pyridine; arylindole; azacyanines; 2-amino-4-aryl-5-thiazole; thiapyrylium; benzopyrylium; pyrylium; 2-heterocyclylin-dole; 2-aryl-1,8-trimethyleneindole; carbazole; 2-aryl-1-alkylin-dole; 5-mercapto-tetrazole, indazole, piazine, thiuram disulfide, nitron, phenozine-N-oxides and N,N'-dialkyl-4,4'-bispyridinium.

According to the present invention the desensitizing compounds have an electron withdrawing group or substituent, wherein said group-or substituent is selected from the type consisting of ace-tyl-, benzosulfonyl-, benzoyl-, carbonyl-, acetoxy-, cyano-, nitro-, hydroxy-, chloro- and sulfonyl-.

Particularly preferred desensitizing agents are the agents corresponding to the following formula(e)

C-1

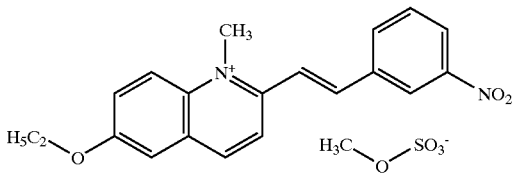

C-2

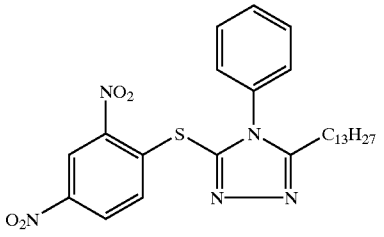

C-3

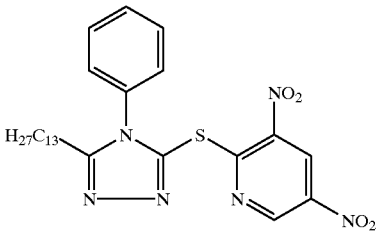

C-4

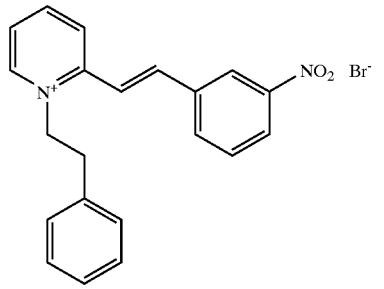

More particularly preferred in the direct X-ray system of the present invention is the use in the film material, as a desensitizing agent, of "Pinakryptol Yellow" [6-ethoxy-1-methyl-2-(3-nitrostyryl) quinolinium methyl sulphate], compound C-1, having a nitro-group as electron-withdrawing group and a quinolinium group as hetero-aromatic part in its structure.

As has already been mentioned, high amounts of desensitizing compounds are preferred, more particularly amounts in the range from 5 to 100 mg per mole of coated silver bromoiodide are envisaged.

Said tabular grain emulsion layer comprises at least 50 percent (70% being more preferred, and even more preferred more than 90%) of the total grain projected area of all grains as silver bromoiodide tabular grains having an iodide content of less than 5 mole %, based on silver; an average aspect ratio of at least 2, and a volume greater than 0.03 $\mu m^3$. For irradiation having a higher energy, it is even recommended to have an average volume of at least 0.06 $\mu$m in said tabular grain emulsion layer(s). Tabular grains having {111} major faces are well-known since the eighties, and have two parallel major faces, wider than the other faces of the grain. Said grains are further characterized by their aspect ratio, defined as equivalent circular diameter (of a circle having same area as the projected grain surface) to thickness, measured from shadowed replicas under a well defined angle. Said grains can have a hexagonal or a triangular form, but a hexagonal form is preferred. The distribution of the grains can be heterodisperse (in the range of at least 0.40) or more disperse (lower than 0.25, and even more preferred in the range from 0.10 to 0.20), said given values being defined as the ratio of standard deviation of average equivalent circular diameter (E.C.D.) to said average E.C.D., when dispersity on E.C.D. is mentioned, or, in the alternative, as the ratio of standard deviation of average grain thickness to said average grain thickness, when dispersity on thickness of the grain is mentioned. Such emulsion grains can be prepared e.g. according to the method described in EP-A's 0 506 947, 0 569 075, 0 577 886, 0 584 189, 0 953 868 and 1 014 175, and in U.S. Pat. Nos. 5,210,013; 5,171,659; 5,147,773; 5,147,772 and 5,147,771 without however being limited thereto.

The tabular silver halide grains essentially comprise silver iodide in an amount of less than 5 mole %, based on silver, and may optionally contain chloride in an amount of at most 10 mole %.

In one embodiment according to the present invention the material has, in one or more photosensitive emulsion layers thereof, coated on one or both sides, silver bromoiodide tabular grains having silver iodide in an amount of at most 1 mole%, based on silver.

Incorporation of iodide ions may further be provided by using aqueous solutions of inorganic salts thereof as e.g. potassium iodide, sodium iodide or ammonium iodide. Iodide ions can however also be provided by organic compounds releasing iodide ions as has e.g. been described in EP-A's 0 561 415, 0 563 701, 0 563 708, 0 649 052 and 0 651 284 and in WO 96/13759. Especially in order to obtain a more homogeneous iodide distribution over the crystal volume in the crystal lattice and over the whole crystal distribution, iodide ions provided by organic agents releasing iodide ions are preferred such as mono iodide acetic acid, mono iodide propionic acid, mono iodide ethanol and even hydrogels containing iodide ions, capable to generate iodide ions. Generation of iodide ions is triggered by changing the pH value in the reaction vessel during or, preferably, after addition of the said organic agent releasing iodide ions. Opposite to the addition of potassium iodide as a source of iodide ions the said organic compounds releasing iodide ions are leading to a more homogeneous iodide ion distribution over the different tabular crystals, thus avoiding undefined heterogeneities and irreproducibilities. Another method of triggering generation of iodide ions is performed by addition of sulfite ions to the reaction vessel. Combinations of inorganic and organic agents providing iodide ions may also be useful. Alternatively very fine silver iodide grains, having a grain diameter of about 0.05 $\mu$m may be added as a source of iodide ions (also in favour of uniformity of silver iodide distribution over the tabular grains as disclosed e.g. in U.S. Pat. No. 5,955,253), and even addition of $KI_3$ is not excluded (see e.g. U.S. Pat. No. 6,033,842). Although normally added during the precipitation step(s) said iodide ions can be added (in small amounts) during the chemical sensitization step (even in form of those small silver iodide grains as has e.g. been described in U.S. Pat. No. 5,411,849. The presence of iodide ions stabilizes the (111)-crystal faces. Although preferred with respect to intrinsic sensitivity or speed, it is recommended to limit average iodide concentrations to up to 5 mole % and even more preferably to limit them in the range from 0.1 mole % to 1.0 mole %, based on the total silver amount as higher concentrations retard development and lead to unsatisfactory sensitivities. Moreover the velocity of fixation can be disturbed and as a consequence residual coloration may be unavoidable.

In another embodiment according to the present invention said material has tabular grains having an average volume between 0.05 and 2 $\mu$m3 and the aspect ratio, defined as the ratio between average equivalent circular diameter of the projected area and average grain thickness of between 5 and 25 wherein said valued have been determined from shadowed electron microscopic replicas.

According to the present invention said material further has a silver content per coated side, expressed as an equivalent amount of silver nitrate, of from 5 up to 25 g/$m^2$.

Grain size distributions of silver brom(oiod)ide crystals over the light-sensitive emulsion are homogeneous or monodisperse by controlling the precipitation methods used. Metal ions or metal ion complexes also called dopants, commonly added in low amounts to the silver brom(oiod)ide crystals in whatever a stage of the preparation, generally have little influence on crystal distributions in the emulsions but may be added to cause advantageous effects with respect to reciprocity, pressure sensitization, etc., as has been described e.g. in U.S. Pat. No. 5,362,619; wherein fine AgI crystals have been added in the precipitation step.

Therefore it is very important to carefully controll pAg, temperature, dilution of the reaction vessel, presence of growth restrainers or growth accelerators, addition rate of added aqueous soluble silver salt and halide solutions during different precipitation steps (especially during the nucleation step during which e.g. less than 10% of the total amount of silver salt available is consumed and further during the at least one growth step during which at least 90% of the said silver salt is consumed), way of mixing and mixing or stirring rate in the reaction vessel during the different precipitation steps leads to homogeneous crystal size distributions having variation coefficients. Depending on the precipitation conditions more heterogeneous distributions can be obtained and may even be more advantageous e.g. from the point of view of exposure latitude but in order to obtain the same effect of e.g. an increasing exposure latitude is reached by making mixtures of different homogeneous emulsions having very low variation coefficients e.g. in the range from 0.05 to 0.15. This may lead to even more advantageous sensitometric characteristics (e.g. increased contrast) or image quality (e.g. granularity and/or sharpness) as has been illustrated e.g. in U.S. Pat. No. 4,446,228 and in EP-A 0 555 897.

The composition of the halide can change in the crystal in a continous or discontinous way. Emulsions containing crystals composed of various sections with different halide compositions are used for several photographic applications. So a structure with a difference in halide composition between the center and the rest of the crystal (what is called 'core-shell'-emulsion) or with more than two crystal parts differing in halide composition (called a 'band'-emulsion) may occur. The changes in halide composition can be realized by direct precipitation or in an indirect way by conversion where fine silver halide grains of a certain halide composition are dissolved in the presence of the so-called host grains forming a 'shell' or 'band' on the given grain.

The silver halide emulsion can be prepared in various ways by conventional methods. These methods always start with a nucleation step, followed by a grain growth step. In this last step of the emulsion preparation reactants are added to the reaction vessel in the form of solutions of silver and halide salts or in the form of preformed silverhalide nuclei or fine grains which easily dissolve in the precipitation medium.

The individual reactants can be added through surface or subsurface delivery tubes by hydrostatic pressure or by an automatic delivery system for maintaining the control of pH and/or pAg in the reaction vessel and of the rate of the reactant solutions introduced in it. The reactant solutions or dispersions can be added at a constant rate or a constantly increasing, decreasing or fluctuating rate, if desired in combination with stepwise delivery procedures. More details about the possible ways in making a silver halide emulsion which can principally be used in this invention are summarized in Research Disclosure, No.38957 (September 1996) section I-C.

Besides the individual reactants necessary to form silver halide crystals additional chemical metal salts can be added for occlusion in the crystal lattice. Such compound is replacing an appropriate amount of silver and halide ions in the silver halide lattice. These compounds, so-called "dopants", can be distinguished from the metal complexes which are added just before coating as an additive by EPR- or ENDOR-technique. These dopants can be used to modify the crystal structure or the crystal properties and can therefore be employed to influence many photographical properties like sensitivity, reciprocity failure, gradation, pressure sensitivity, fog, stability, etc. When coordination complexes or even oligomeric coordination complexes are used the different ligands bound at the central metal ion can be occluded in the crystal lattice too and in this way influence the photographic properties of the silver halide materials as well. Dopants when introduced in emulsions of the present invention are those which can act as a permanent or as a non-permanent electron trap.

The doping procedure itself can normally be executed at any stage during the grain growth phase of the emulsion preparation. It is important to know that the dopants can also be added in an indirect way by the addition of a dispersion containing very fine soluble silver halide grains or nuclei comprising the dopant. More additional information about the introduction and the use of dopants in the emulsion crystals can be found in Research Disclosure, 38957 (September 1996), section I-D. Doping agents, generally in small quantities, such as rhodium, indium, osmium, iridium and ruthenium ions can be added and incorporated in a way as has further been disclosed in e.g. in U.S. Pat. Nos. 5,306,613; 5,399,476; in EP-A's 0 933 670, 0 933 671, 1 045 282 and in EP-A 1 058 150. Incorporation of organic hole trapping dopants, e.g. making use of formic acid, rongalites etc., can also be applied as described in EP-A 0 922 994.

As is well-known gelatin is normally used as a protective colloid for the silver halide emulsion crystals during precipitation. The preparation of conventional lime-treated or acid treated gelatin has been described in e.g. "The Science and Technology of Gelatin", edited by A. G. Ward and A. Courts, Academic Press 1977, page 295 and next pages. The gelatin can also be enzyme-treated as described in Bull. Soc. Sci. Phot. Japan, No. 16, page 30 (1966).

A preparation method of tabular grain emulsions wherein in the grain growth process use is made of gelatin derivatives with chemically modified $NH_2$-groups and wherein said gelatin has a specific methionine content has been described in e.g. EP-A 0 697 618. Gelatin may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch; and alginates. In general, the semi-synthetic substitutes for gelatin are modified natural products e.g. gelatin derivatives obtained by conversion of gelatin with alkylating or acylating agents, by grafting of polymerizable monomers on gelatin or prehardened gelatins with blocked functional groups as a consequence of this prehardening treatment, cellulose derivatives such as hydroxyalkyl cellulose, carboxymethyl cellulose, phthaloyl cellulose, and cellulose sulphates and even cationic starch, whether or not in oxidized form. Further synthetic high molecular compounds described in JP-B-52-16365, Journal of The Society of Photographic Science and Technology of Japan, Vol. 29(1), 17, 22(1966), ibid., Vol. 30(1), 10, 19(1967), ibid., Vol. 30(2), 17(1967), and ibid., Vol. 33(3),24(1967) may be used as a dispersion medium. Also the crystal habit restraining agent described in EP-A 0 534 395 may be used.

Part of gelatin may further be replaced with a synthetic or natural high-molecular material. An interesting substitute for gelatin may be silica as has been described in the published EP-A's 0 392 092, 0 517 961, 0 528 476, 0 649 051, 0 677 773 and 0 704 749.

For the precipitation processes wherein suitable silica sols are required as colloidal binder commercially available such as the "Syton" silica sols (a trademarked product of Monsanto Inorganic Chemicals Div.), the "Ludex" silica sols (a trademarked product of du Pont de Nemours & Co., Inc.), the "Nalco" and "Nalcoag" silica sols (trademarked products of Nalco Chemical Co), the "Snowtex" silica sols of Nissan Kagaku K.K. and the "Kieselsol, Types 100, 200, 300, 500 and 600" (trademarked products of Bayer AG). Particle sizes of the silica sol particles are in the range from 3 nm to 30 $\mu$m. The smaller particles in the range from 3 nm to 0.3 $\mu$m, and still more preferable from 3 nm up to 7 nm are preferred as the covering degree that can be achieved will be higher and as the protective action of the colloidal silica will be more effective.

At the end of the precipitation, following all possible physical ripening steps, the emulsion mixture is normally cooled to about 40° C., before or after adding a flocculate being a polymeric compound as e.g. polystyrene sulphonic acid, providing as a anionic polymer a behaviour depending on pH. Under carefully controlled conditions of addition and stirring rate the pH of the said dispersing medium is adjusted with an acid to a value in order to get a qualitatively good flocculate. Said flocculate may become decanted and washed with demineralized water in order to remove the soluble salts and the development inhibiting crystal habit modifier e.g. adenine to an allowable residual amount (preferably at most 0.3 mg/g of gelatin) or applying an ultrafiltration washing procedure as disclosed e.g. in Research Disclosure, Vol. 102, October 1972, Item 10208, Research Disclosure Vol. 131, March, Item 13122 and Mignot U.S. Pat. No. 4,334,012. Said ultrafiltration technique may be applied on-line during the whole precipitation, in order to reduce the increasing amount of water, thus avoiding dilution of the reaction vessel and increasing amounts of soluble salts like the mainly occurring potassium nitrate. Examples thereof have been described e.g. in EP-A 0 577 886. When the emulsion after precipitation is washed by diafiltration by means of a semipermeable membrane, a technique also called ultrafiltration, it is not necessary to use polymeric flocculating agents that may disturb the coating composition stability before, during or after the coating procedure. Such procedures are disclosed e.g. in Research Disclosure Vol. 102, October 1972, Item 10208, Research Disclosure Vol. 131, March, Item 13122 and U.S. Pat. No. 4,334,012. Redispersion may further be performed by addition of extra hydrophilic colloid. As a consequence values of gesi and/or sisi may be enhanced up to values desired in order to prepare stable coating solutions. It is clear however that any useful protective colloid cited hereinbefore as an alternative of gelatin or gelatin in modified form may be used.

As already set forth additional gelatin or another hydrophilic colloid, suitable as a binder material can be added at a later stage of the emulsion-preparation as e.g. after washing, in order to establish optimal coating conditions and/or to establish the required thickness of the coated emulsion layer. Preferably a gelatin to silver halide ratio, silver halide being expressed as an equivalent amount of silver nitrate, ranging from 0.3 to 1.0 is then obtained. Another binder may also be added instead of or in addition to gelatin. Useful vehicles, vehicle extenders, vehicle-like addenda and vehicle related addenda have been described e.g. in Research Disclosure No. 38957 (1996), Chapter II.

As the material of the present invention is not exposed to irradiation in the wavelength range of the visible spectrum, said tabular grain emulsion layer(s) is(are) free from spectrally sensitizing dyes, as presence of such dyes could lead to incomplete decolourization thereof.

The {111} tabular emulsion grains are normally subjected to chemical ripening or sensitization in the presence of sensitizing compounds essentially comprising at least one gold salt (preferably added in an amount of at least 0.010 mmole per mole of silver) and a sulfite salt (normally added in an amount of at least 0.05 mmole per mole of silver). Silver solvents have a regulating role therein, especially those comprising thiocyanate ions. From such combination of gold salts and sulfite in the chemical ripening step a never expected improvement in developablity, more particularly in exhausted developer compositions, could be provided, as has clearly been illustrated in the patent application, concurrently filed herewith. Besides the noble metal sensitization with gold salts, noble metal sensitization with another salt of a noble metal as e.g. iridium, palladium, platinum, preferably in minor amounts versus gold, may be applied. Examples of the gold sensitizers which are preferably used include chloroauric acid, goldsulfide, chloroaurate salts, aurithiocyanate and gold selenide. The amount of the gold sensitizer should be applied in order to specifically encounter the desired requirements, specifically related with the object to reach an optimized speed to fog relationship. Sulfur sensitization can be further be carried out with sulphur compounds like thiosulphates, thioureas, rhodamines, etc. The sulphur sensitizer can also be used in an amount of about $10^{-8}$ to $10^{-2}$ mole per mole silver halide. Selenium sensitization and even tellurium sensitization can optionally be applied, as e.g. disclosed in U.S. Pat. Nos. 5,273,874; 5,215,880; 5,561,033; 5,393,655; 5,547,829; 5,573,901; 5,888,717; 5,677,120; in EP-A 0 404 142, 0 443 453 and 0 572 663, in GB-A 2,316,184, in DE 19924669 and in EP-A 1 070 986. Addition of selenium compounds generating silver selenide in well-defined circumstances can be in favour of speed, particularly when high-energy radiation exposure is envisaged, such as from a Co-60 source, more particularly with radiation having high energy, such as energies of 1.1 and 1.3 MeV as is the case for a Co-60 source or from a source for X-rays further comprising a high energy tube or even a synchrotron. High energy elementary particle radiation, generated from said high energy tube or from a synchrotron, as e.g. β-rays, electron beam or neutron radiation can also be captured.

As has been described in the patent application, filed simultaneously herewith, selenium compounds providing high speed are preferably compounds selected from the group consisting of substituted selenoureum, substituted triphenyl-phosphine selenide and substituted and unsubstituted triphenyl-orthophosphate selenide (without however representing an exhaustive summary) to be added in preferred amounts of from 0.5 up to 20 μmole per mole of silver nitrate. Commonly said selenium sensitizers are used together with other sensitizers as at least gold (in minimum amounts as indicated above, together with sulfite salts) and optionally sulphur and/or even tellurium. Especially useful labile compounds providing sulphur are compounds selected from the group consisting of tetramethyl-thiodithioacetic acid diamide, dimethylamino-dithiomercaptane, thiosulphate and thiosulphonate compounds. Other useful compounds are those as described e.g. in "Chimie et Physique Photographique" by P. Glafkides, in "Photo-graphic Emulsion Chemistry" by G. F. Duffin, in "Making and Coating Photographic Emulsion" by V. L. Zelikman et-al, and in "Die Grund-lagen der Photographischen Prozesse mit Silberhalogeniden" edited by H. Frieser and published by Akademische Verlagsgesellschaft (1968).

Reduction sensitization by means of a reducing compound like thiourea dioxide, hydrazine derivatives, sulphinic acid, polyamine compounds, stannous chloride, borane compounds, reductones like ascorbic acid, etc., may further be applied. Further reductors as e.g. tin compounds as described in GB-A 789,823, amines, hydrazine derivatives, formamidine-sulphinic acids, and silane compounds may be used, although care should be taken in order to prevent the emulsion from fog formation in an uncontrollable way.

Reduction sensitization can also be carried out at a low pAg or a high pH or at both and if desired at elevated temperature. This kind of sensitization is refered to 'silver ripening'. More information can be found in Research Disclosure, Vol. 307, No. 307105 and in P. Glafkides "Chimie et Physique Photographic", P. Montel—Paris, $5^{th}$ Ed.,1987. Preparation of a material can be performed, said preparation comprising the step of chemically sensitizing under conditions of pAg in the range of 6 till 11, preferably between 7 and 10; in conditions of pH in the range of 3 to 10 preferably 4 to 8.5, while the temperature is in the range between 40 to 95° C., preferably between 45 and 85° C., without however being limited thereto. As described in said literature chemical sensitization can be carried out by effecting the ripening in the presence of small amounts of compounds containing sulphur as e.g. thiosulphate, thiocyanate, thioureas; sulphites, mercapto compounds, rhodamines etc., wherein combinations of gold-sulphur ripeners together with the required selenium sensitizers are the most preferred. Addition of tellurium compounds as e.g. tellurosulphate, tellurocyanate, telluroureas in very small amounts is thereby however not excluded.

Stabilizing agents, added in the chemical ripening process of silver halide emulsion crystals, are not excluded. Depending upon the circumstances it may be recommended to use small amounts in order to counterbalance the restraining actions from fog-restrainers or stabilizers as e.g. substituted heterocyclic mercapto-compounds described in U.S. Pat. No. 5,242,791. Addition of said stabilizers may be performed before, during or after chemical sensitization.

It is a common method to add chemical sensitizers after redispersion. As, according to a preferred embodiment, the material of the present invention has emulsions, free of spectrally sensitizing dyes, the moment of addition of the chemical sensitizing agents is less critical as otherwise addition of chemical sensitizers during and/or after spectral sensitization would be preferred. Before starting chemical sensitization the surface of the tabular silver halide grains may be treated with slightly oxidizing compounds as e.g. toluene thiosulphonic acid and/or corresponding salts thereof in order to reduce small silver specks to grow to fog centers in an uncontrolled manner.

Compounds preventing formation of fog or stabilizing the photographic characteristics during the production or storage of the photographic elements or during the photographic treatment thereof are required and are, in most cases, already present during emulsion precipitation and/or chemical sensitization. Many known compounds can be added as fog-inhibiting agent or stabilizer to the silver halide emulsion layer or to other coating layers in water-permeable relationship therewith such as an undercoat or a protective layer. Suitable examples are e.g. those described in Research Disclosures N$^{os}$ 17643 (1978), Chapter VI and 38957 (1996), Chapter VII.

The photographic film material or element used the system of the present invention may further comprise various kinds of coating physical property modifying addenda, as described in Research Disclosure No. 38957 (1996), Chapter IX, wherein coating aids, plasticizers and lubricants, antistats and matting agents have been described.

Development acceleration can be accomplished by incorporating in emulsion layer(s) or adjacent layers various compounds, preferably polyalkylene derivatives having a molecular weight of at least 400 such as those described in e.g. U.S. Pat. Nos. 3,038,805; 4,038,075 and 4,292,400 as well as in EP-A's 0 634 688 and 0 674 215.

The photographic element may further comprise various other additives such as e.g. compounds improving the dimensional stability of the photographic element, ultraviolet absorbers and spacing agents. Suitable additives for improving the dimensional stability of the photographic element are e.g. dispersions of a water-soluble or hardly soluble synthetic polymer e.g. polymers of alkyl(meth) acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, αβ-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. No. 3,314,794 and 3,352,681, benzophenone compounds as described in JP-A 56-2784, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in Research Disclosure No. 38957(1996), Chapter VI, wherein also suitable optical brighteners are mentioned.

Spacing agents may be present of which, in general, the average particle size is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydro-phthalate. Other suitable spacing agents have been described in U.S. Pat. No. 4,614,708.

In direct X-ray photography the material normally has a duplitized emulsion layer coated on both sides (double-side coated) of the support. A mixture of two or more emulsions having silver brom(oiod)ide crystals with the same or different crystal sizes, the same or a different crystal habit, same or a different halide composition and/or a different or the same chemical ripening treatment, may be added to at least one light-sensitive emulsion layer, provided that (as an essential feature of the present invention) on at least one side of the support of the material there is a tabular grain emulsion layer in which at least 50 percent of total grain projected area is accounted for by silver bromoiodide tabular grains having an iodide content of less than 5 mole %, based on silver, having an average aspect ratio of at least 2 and having a volume greater than 0.03 $\mu m^3$, and characterized in that said tabular grain emulsion layer(s) comprise(s), in an amount of from 5 to 100 mg per mole of coated silver bromoiodide, at least one desensitizing agent having a hetero-aromatic part and an electron-withdrawing group inits structure.

Besides the radiation-sensitive emulsion layer(s) the photographic material may contain several light-insensitive layers at the side of the support carrying said light-sensitive emulsion layer(s), e.g. a protective antistress layer which can be split up into two layers, one of them being an underlying interlayer or an outermost afterlayer coated or sprayed on top of the "basic" protective antistress layer, one or more subbing layers, one or more intermediate layers, and even an afterlayer containing e.g. hardening agent(s), antistatic agent (s) and, optionally, filter dyes for safety-light purposes etc. Presence of desensitizing agents in those layers is, however, not excluded, provided that as an essential feature at least one desensitizer as claimed is present in at least one photosensitive layer having tabular grains as described is present in amounts as prescribed before.

Protective antistress layers preferably contain coating aids and coating physical property modifying addenda mentioned in Research Disclosure No. 38957, published September 1996, Chapter IX. Antistatic properties are especially preferred in order to prevent blackening after processing in form of sparks, etc. due to abrupt decharging of electrostatic charges during production and/or handling before exposure and/or processing. It is highly preferred to add antistatic agents to the protective antistress layer or to an afterlayer coated thereupon as has been described erg. in EP-A's 0 534 006, 0 644 454 and 0 644 456 and in U.S. Pat. Nos. 4,670,374 and 4,670,376. In another embodiment antistatic agents as polythiophenes, or oxides of vanadium, tin, etc., can also be added. Especially addition to the subbing layers of PEDT (a polythiophene) as described in EP 1 031 875 is recommended. Abrasion resistance of these outermost layers may be improved as described in U.S. Pat. Nos. 4,766,059 and 4,820,615. Spraycoating of afterlayers has been disclosed e.g. in U.S. Pat. No. 5,443,640. Measures in order to further suppress pressure sensitivity, besides by the essential feature of the present invention to make use of relatively high amounts of desensitizing compounds as claimed, may be coating of enhanced amounts of binder as e.g. gelatin. This however is not preferred and disadvantageous with respect to rapid processing, especially drying, but other measures as set forth in U.S. Pat. No. 5,620,836 can also be applied in the present invention, offering moreover the particular advantage that less silver can be coated in the material according to the present invention. An additional improvement of pressure sensitivity can be expected if use is made in the binder of the material according to the present invention from synthetic clays as has been disclosed in U.S. Pat. No. 5,478,709.

In addition thereto it is recommended to prepare aqueous solid dispersions in colloidal silica for any photographically useful compound as has been suggested e.g. in EP-A 0 569 074. Advantages with respect to thin layer coating and rapid processing ability can be expected with relation thereto, without enhancing pressure sensitivity of more vulnerable layers.

The support of the radiographic elements of the present invention preferably is a blue colored polyester support like polyethylene terephthalate. The thickness of such organic resin film is preferably about 175 $\mu$m. Other suitable hydrophobic resin supports are well known to those skilled in the art and are made e.g. of polystyrene, polyvinyl chloride, polycarbonate and polyethylene naphthalate. The support is further provided with a substrate layer at both sides to have good adhesion properties between the adjacent layers and said support: one or more subbing layers known to those skilled in the art for adhering thereto a hydrophilic colloid layer may be present. Suitable subbing layers for polyethylene terephthalate supports are described e.g. in U.S. Pat. Nos. 3,397,988, 3,649,336, 4,123,278 and 4,478,907. A preferred layer arrangement wherein a subbing layer composition comprising as a latex copolymer vinylidene chloride, methylacrylate and itaconic acid has been covered with hydrophilic layers being at least one gelatinous dye containing layer comprising one or more dyes, at least one silver halide emulsion layer, at least one protective antistress layer, and optionally an afterlayer has been described in EP-A 0 752 617. In that invention said hydrophilic layers have a swelling ratio of not more than 200% and in said hydrophilic layers are coated simultaneously by the slide-hopper coating or by the slide-hopper curtain coating technique. Further information on suitable supports can be found in Research Disclosure No. 38957, Chapter XV, published September 1996.

Prior to coating any thickening agent may be used in order to regulate the viscosity of the coating solution, provided that they do not particularly affect the photographic characteristics of the silver chloroiodide emulsion in the coated photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica. Polymeric thickeners well-known from the literature resulting in thickening of the coating solution may even be used in combination with colloidal silica. Patents concerning thickening agents are e.g. U.S. Pat. No. 3,167,410; Belgian Patent No. 558.143 and JP-A's 53-18687 and 58-36768. Negative effects on physical stability possibly resulting from the addition of polymeric compounds can be avoided by exclusion of those compounds and by restricting extra additions of colloidal silica. In order to coat hydrophilic colloidal layer compositions on a support by slide-hopper or curtain-coating techniques, wherein said compositions have gelatin in low amounts in order to provide a ratio by weight of gelatin to silver halide expressed as an equivalent amount of silver nitrate in the range from 0.05 to 0.4, thickening agents composed of synthetic clay and anionic macromolecular polyelectrolytes wherein said synthetic clay is present in an amount of at least 85% by weight versus the total amount of thickening agents are recommended as has been disclosed in EP-A 0 813 105.

In order to reach a high hardening degree the layer binder should of course dispose of an acceptably high number of functional groups, which by reaction with an appropriate hardening agent can provide a sufficiently resistant layer. Such functional groups are especially the amino groups, but also carboxylic groups, hydroxy groups, and active methylene groups. Hardeners may be added to the antistress layer, covering one or more light-sensitive silver halide emulsion layers before or during the coating procedure, or to one or more of the said emulsion layers. The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexa-hydro-s-triazine, active halogen compounds e.g. 2,4-dichloro-6-hydroxy-s-triazine, and mucohalogenic acids e.g. mucochloric acid and mucophenoxy-chloric acid. These hardeners can be used alone or in combination. The binders can also be hardened with fast-reacting hardeners such as carbamoylpyridinium salts. Formaldehyde and phloroglucinol can e.g. be added respectively to the protective layer(s) and to the emulsion layer(s). Preferred hardening agents in the context of the present invention however are bis-(vinyl-sulphonyl)-methane (BVSME) and ethylene bis-(vinyl-sulphone).

Materials for use in the system according to the present invention,and, more particularly for use in the image-forming method according to the present invention, commonly have a hardening degree in order to have an absorption of water, as can be measured in a processing cycle after rinsing and before drying not, of not more than 2 g per g of gelatin coated as has already been disclosed before in EP-A 0 698 817 and in the corresponding U.S. Pat. No. 5,620,836. A lot of other ingredients are further required in order get suitable sensitometric properties, as e.g. sensitivity (also called speed), gradation (also called contrast) and fog in the preferred processing conditions for the materials coated from silver brom(oiod)ide emulsions used in the element according to the present invention.

The material used in the system of the present invention can be exposed either directly or through an intensifying screen. In the scope of the present invention, an "intensifying screen" is a metal screen which enables the proportion of X-ray or $\gamma$-radiations absorbed by the silver halide grains to be increased. The X-rays interact with the intensifying screen, producing electrons in all directions. Some of these electrons will be absorbed by the silver halide grains in the emulsion layer in order to form latent image sites. By increasing the number of electrons emitted in the direction of the grains, the quantity of electrons absorbed by the grains is increased. As the "intensifying screen" is not comparable with a "luminescent phosphor screen" as is used in "indirect X-ray imaging" the system according-to the present invention remains a so-called "direct X-ray system".

When the radiographic material of the invention is exposed to X- or γ-rays, the sensitivity (speed) obtained is notably higher than that obtained with a radiographic element consisting of three-dimensional grains, for an identical grain volume, even when thin tabular grains are used, having a high aspect ratio, opposite to the normally expected absorption reduction of X- or γ-rays by the said thin tabular grains, which permit the use of a silver content, being up to 25% lower than in the presence of emulsions with thick or three-dimensional grains of the elements for industrial radiography.

According to the present invention a direct X-ray system is thus provided, wherein a preferred material is a radiographic industrial non-destructive testing material. In another preferred embodiment according to the present invention said material is a material for personal monitoring. According to the present invention a personal electromagnetic radiation monitor is provided, said monitor being wearable by a person to warn the person of a radiation hazard condition caused by electromagnetic radiation emanating from a source of electromagnetic radiation, said monitor essentially comprising a material according to the present invention.

The direct X-ray system of the present invention commonly makes use of a radiographic system consisting of two intensifying screens disposed on each side of the radiographic element, wherein said screens do not emit visible light (as they generate more electrons as being electron intensifying screens). The said screens normally used are screen sheets selected from the group consisting of lead, lead oxide, and dense metals such as copper and steel. The thickness of these screens is between 0.025 mm and 0.50 mm, depending on the type of ionizing radiation used.

According to the present invention a system for industrial radiography is further provided, said system being comprised of an industrial radiographic material having the specific features of the present invention as disclosed before and, disposed on opposite sides of the radiographic element, two intensifying screens designed to emit electrons when exposed to X- or γ-rays with an energy greater than or equal to 10 kVp.

According to the present invention an image-forming method in order to get an industrial radiographic image has further been disclosed, wherein said method comprises the steps of exposing a system as set forth hereinbefore to X- or γ-rays with an energy greater than or equal to 10 kVp in order to form a latent image, and developing the said latent image. By the method according to the present invention an automated non-destructive test system to a manufacturing process is provided, said process comprising the steps of providing at least one source for X-rays or γ-rays; and providing an object under test exposed to said X-rays or γ-rays, said object being operable to selectively absorb said X-rays or γ-rays.

The radiographic image is thus obtained by exposing, to X- or γ-rays, either directly or through an intensifying screen as set forth above, a radiographic element which comprises a support covered on at least one side of the support material with a layer of silver halide emulsion grains comprising tabular grains having an aspect ratio greater than or equal to 2 and a tabular grain volume of at least 0.03 $\mu m^3$, thereby forming a latent image, and by developing the exposed element by making use of conventional processing methods or, in a more preferred embodiment, by "ecological" processing methods. With respect to said "ecological" processing methods, hardener-free black-and white developers are used, having ascorbic acid (as a more biodegradable developing agent instead of the conventional developing agents as dihydroxybenzene compounds or aminophenoles) as well as hardener-free fixers free from aluminum and/or ammonium salts, wherein said fixers further comprise a solvent for silver halides such as thiosulphate, thiocyanate or sulphurated organic compounds.

According to the present invention said method thus provides a step wherein developing the said latent image is performed in a developing bath which contains ascorbic acid as a developing agent. In a particularly preferred embodiment, according to the method for forming an industrial radiographic image of the present invention, said latent image is developed in a developing bath which contains ascorbic acid as the developer. Information about such developers can be found e.g. in EP-A 0 732 619 and in U.S. Pat. Nos. 5,593,817; 5,604,082; 5,895,743 and 5,948,602; and in Research Disclosures Nos. 371052 (p. 185–224) and 352049 (p. 542–543), published Mar. 1, 1995 and Aug. 1, 1993 respectively. As an auxiliary developing agent presence of a phenidone compound is recommended, as e.g. 4-hydroxymethyl-4-methyl-1-phenyl-3-pyrazolidinone as a 1-phenyl-3-pyrazoli-dinone developing agent. If per se required for whatever a reason presence of hydroquinone as a developing agent, in a mixture with ascorbic acid, can be useful.

In a further preferred embodiment the method according to the present invention comprises the steps of (1) exposing a system as disclosed hereinbefore, wherein said radiographic material is fully forehardened, and (2) developing the latent image obtained by exposure in a developing bath without further hardening.

Processing the material according to the present invention thus preferably proceeds by the steps of developing, fixing, rinsing and drying, wherein developing proceeds in a developing solution comprising(iso)ascorbic acid, 1-ascorbic acid, reductic acid, salts and/or derivatives thereof; fixing in a fixer solution free from aluminum salts and, optionally, ammonium salts; rinsing and drying.

Replenishing said developing and fixer solution normally proceeds with amounts of replenisher in the range from 300 up to 900 ml/$m^2$, more preferably from 300 up to 600 ml/$m^2$, and from 400 up to 1200 ml/$m^2$, more preferably from 400 up to 700 ml/$m^2$, respectively. For the said processing, preferably an automatically operating apparatus is used provided with a system for automatic replenishment of the processing solutions. The processing therein proceeds within a relatively short processing time of from 1.5 up to 15 minutes from dry-to-dry, and more preferably, and realistic, from 3 up to 8 minutes, for materials used in the image forming system of the present invention as with the radiographic element according to the invention, it is possible to use silver contents up to 25% lower than the silver contents of the emulsions with thick or three-dimensional grains of the elements for industrial radiography. A normally used configuration in the automatic processing apparatus shows the following consecutive tank units corresponding with, as consecutive solutions: developer-fixer-rinse water. In order to reduce "sludge formation" which is favored by solubilizing agents like sulfites, present in the developer as preservatives, a particularly suitable developer solution is the one comprising a reduced amount of sulfite and ascorbic acid which acts as a main developer and anti-oxidant as well and which is called "low-sludge" developer.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868.

A particularly suitable fixer solution comprises an amount of less than 25 g of potassium sulfite per liter without the presence of acetic acid wherein said fixer has a pH value of at least 4.5, in order to make the fixer solution quasi odourless. The presence of α-ketocarboxylic acid compounds may be useful as has been described in EP-A's 0 620 483 and 0 726 491 and in Research Disclosure No. 16768, published March 1978. It is possible to use sodium thiosulphate as a fixing agent, thus avoiding the ecologically undesired ammonium ions normally used. For the relatively low coating amounts of silver halide as in the elements of the present invention a fixation time which is reduced to about 100 seconds can be attained.

In another embodiment the developer solution used in the method according to this invention should be replenished not only for decrease of the liquid volume due to cross-over into the next processing solution but also for pH-changes due to oxidation of the developer molecules. This can be done on a regular time interval basis or on the basis of the amount of processed film or on a combination of both. In these circumstances, no dilution and mixing procedures are required before the regeneration bottles are adjusted to the processing unit. Moreover regeneration is kept to a minimum, especially in the processing of materials coated from lower amounts of emulsion crystals rich in silver bromide. Replenishment of a developer comprising ascorbic acid or derivatives thereof and a 3-pyrazolidone derivative can be done as has been described in EP-A 0 573 700, wherein a method has been disclosed for processing with constant activity of image-wise exposed silver halide photographic material and wherein replenishing said developing solution proceeds by means of at least one replenishing solution having a higher pH than the developing solution. Other useful references related therewith, applicable with respect to the present invention, are e.g. EP-A's 0 552 511 and 0 660 175 and U.S. Pat. Nos. 5,503,965; 5,895,743 and 6,083,672.

The present invention is illustrated by the following examples, without however being limited thereto.

EXAMPLES

While the present invention will hereinafter be described in connection with preferred embodiments thereof, it will be understood that it is not intended to limit the invention to those embodiments.

Example I

The effect of the addition of a desensitiser to a material for industrial radiography containing tabular AgBr(I) crystals on the photographic properties is illustrated hereinafter.

Preparation of Emulsion T, Having Tabular Grains

To a solution of 5.5 g of oxidised gelatine (less than 30 μmole methionin per g) in 3 l of demineralized water, adjusted to a pBr of 2.4 by adding KBr and a pH of 1.7 by adding $H_2SO_4$, were added by a double jet addition method aqueous solutions of 1.96 M $AgNO_3$ (hereinafter referred to as S1) and 1.96 M KBr (hereinafter referred to as S2) both at a constant flow rate of 16 ml/min during 27 seconds. During this period, the reaction mixture was maintained at 51° C. When the addition was completed, stirring continued during 1.5 minutes and then, temperature was increased up to 70° C. over a period of 25 minutes, followed by addition of a NaOH solution over a period of one minute in order to adjust pH to a value of 5.6. Then stirring continued for 2.5 minutes and 0.5 l of a 10% gelatin solution, kept at 70° C., was added. After stirring during another 5.5 minutes, S2 was added in a single jet at 7.5 ml/min over a period of 5.5 minutes. Then S1 at a constant flow rate of 7.5 ml/min and S2 at a flow rate, controlled in order to maintain pAg at 8.9, were added by double jet addition over a period of 1 minute. This double jet was continued during another period of 33 minutes and 23 seconds, while the flow rate of S1 was linearly increased up to 23.1 ml/min and pAg was maintained at 8.9. 5 minutes after the completion of said double jet addition; S1 was added at 7.5 ml/min during 7 minutes and 20 seconds. Then another double jet started of S1 at 7.5 ml/min during 1 minute and 40 seconds and an aqueous solution of 1.93 M KBr and-0.03 M KI at a controlled flow rate in order to maintain pAg at 7.4. This double jet was continued during another period of 40 minutes and 56 seconds, while the flow rate of S1 was linearly increased up to 36.8 ml/min and pAg was maintained at 7.4. The average grain size, derived from electron microscopic photographs and calculated as average equivalent circular diameter of the corresponding tabular grains of the emulsion thus prepared was 0.78 μm, the average thickness was 0.22 μm and the variation coefficient was 0.30. The iodide content was 1 mole % based on silver. After washing, gelatine and water were added in order to obtain a silver halide content of 245 g/kg, expressed as $AgNO_3$, and gelatine content of 83 g/kg. The pH was adjusted to 6.0.

Chemical Ripening:

Per mole of AgBr(I) following addenda were consecutively furnished, providing a time of 10 minutes between their addition:

0,85 ml of a water solution containing $6{,}33\times10^{-3}$ M sodium thiosulphate.

27 ml of a water solution containing $1.46\times10^{-3}$ M chloroauric acid and $1.58\times10^{-2}$ M ammonium thiocyanate.

26 ml of a water solution containing $7{,}93\times10^{-3}$ M $Na_2SO_3$.

The emulsions were heated for 4 hours at 52° C.

After cooling, a preservative was added.

Coating of the Emulsion:

Compounds added to the silver bromoiodide emulsion, in grams per mole of equivalent amounts of $AgNO_3$.

TABLE I

| Compound | Amount in g Per mole of $AgNO_3$ |
|---|---|
| Gelatine | 63 g |
| Compound I | As indicated in table III. |
| 4-hydroxy-6-methyl-1,3,3a,7-tetraazaindene | 0.824 g |
| Resorcinol | 3.828 g |
| Bis-metasulphophenyl-disulphide | 0.252 g |

The composition of the top-coating (protective antistress layer) in g per $m^2$ after coating has been given in Table II.

TABLE II

| Compound | Amount in g/m2 |
|---|---|
| Gelatine | 1.89 |
| Polymethylmethacrylate spacing agent (average particle diameter 3 mm) | 0.011 |

TABLE II-continued

| Compound | Amount in g/m2 |
|---|---|
| Chromium acetate | 0.0077 |
| $CF_3—(CF_2)_6—COOH.NH_3$ | 0.0074 |
| 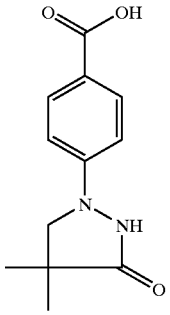 | 0.054 |
| $CF_3—(CF_2)_6—CONH—(CH_2CH_2O)_{17-20}—H$: | 0.020 |
| Mobilcer Q (a paraffin wax, trade name product from MOBIL OIL) | 0.023 |
| Polythioether A (modified poly-epichlorohydrine having an average chain length of approximately 20 monomer units and of which about 50% of the chloride groups have been replaced by a $—S—CH_2—CHOH—CH_2OH$ substituent) | 0.042 |
| Bis-vinyl-sulphonyl-methyl ether (added just before coating) | 0.130 |

Coating of the Materials

The photographic materials according to these examples comprise one emulsion layer and one protective layer, coated symmetrically in the same way at both sides of a blue coloured polyethylene terephthalate support having a density for white light of 0.150 and a thickness of 175 $\mu$m. The coating solution of the emulsion layer was prepared by adding solutions of the compounds indicated in Table 1 to the emulsions dissolved while heating and stirring. The coating solution of the protective layer has been given in Table 2.

After adjusting the pH to 6.8, the viscosity and surface tension of the coating solutions were optimised according to the requirements of the coating method.

The emulsion layer and the protective layer were coated simultaneously on one side of the subbed polyester support, mentioned hereinbefore by means of the conventional slide hopper coating techniques. The silver coverage of the emulsions was 11.5 $gm^2$, expressed as equivalent amount of $AgNO_3/m^2$ per side.

Exposure Conditions, Processing Conditions and Determination of Sensitometric Parameters Samples of said coated and dried films were exposed according to ISO7004 with a 220 kV radiation source with a copper filter of 8 mm thickness.

The exposed samples were developed, fixed, rinsed and dried in an automatic processing machine, called Stucturix NDT-S, marketed by Agfa-Gevaert. The processing cycle was 8 minutes; the developer temperature was 28° C. Developer and fixer solutions were the commercially available Agfa-Gevaert NDT G135 and G335 respectively.

After processing the following sensitometric parameters were determined:

(i) $D_{min}$: optical density in thousands of log units of a non-exposed sample including the density of the blue colored polyester layer layer;

(ii) Speed: measured as the log E value at a density of Dmin+2.0 (a lower figure is representative for a higher speed).

Determination of Pressure Fog.

Bullets of ⅛ inch, loaded with weights of respectively 200, 500 and 1000 grams, were slipped over unexposed samples of the photographic materials. Thereafter the samples.were processed as described above and the blackening of the samples, due to the pressure of the bullets, was qualitatively judged. A quotation from 1 to 5 was given, with 1 being given to the samples with the lowest blackening.

The results thus obtained have been summarised in Table III.

TABLE III

| Desensitizer | Amount in mg/ mole of Ag | $D_{min}$ | 220 kV speed | Pressure Sensitization |
|---|---|---|---|---|
| Structurix D7 4370041 | | 200 | 0.153 | |
| | 0 | 173 | 0.151 | 4 |
| Compound I | 7.5 | 160 | 0.148 | 1 |

The results in Table III show that addition of desensitizing compound I results in a significant decrease in pressure sensitization and, moreover in a lower fog and higher sensitivity. (speed).

Having described in detail preferred embodiments of the current invention, it will now be apparent to those skilled in the art that numerous modifications can be made therein without departing from the scope of the invention as defined in the appending claims.

What is claimed is:

1. A direct X-ray system comprised of (1) a black-and-white negative-working radiographic film material, comprised of a transparent support coated on at least one side thereof with a tabular grain emulsion layer, substantially free from spectrally sensitizing dyes, in which at least 50 percent of total grain projected area of all grains is accounted for by silver bromoiodide tabular grains having an iodide content of less than 5 mole %, based on silver, having an average aspect ratio of at least 2, and having a volume greater than 0.03 $\mu m^3$, further characterized in that said tabular grain emulsion layer(s) comprise(s), in an amount of from 5 mg up to 100 mg per mole of coated silver bromoiodide at least one desensitizing agent having a hetero-aromatic part and an electron-withdrawing group; and (2) disposed on opposite sides of the radiographic element, two intensifying screen sheets selected from the group consisting of lead, lead oxide, copper and steel, said screen sheets designed to emit electrons when exposed to X- or γ-rays with an energy greater than or equal to 10 kVp.

2. System according to claim 1, wherein in the film material said hetero-aromatic part in said desensitizing agent is selected from the group consisting of benzo-selenazole; benzo-thiazole; 1-cyclo-hexylpyrrole; 1,2-diaryl-indole; pyrrolo-[2,3-b]pyrazine; pyrrolo[2,3-b]pyridine; pyrrolo[2,3-b]quinoxaline; imidazo[4,5-b]quinoxaline; imidazo[1,2-b]pyridazine; quinolinium; imidazo[2,1-b]-1,3,4-thiadiazole; imidazo[2,1-b]-thiazole; imidazo[1,2-a]pyridine; arylindole; azacyanines, 2-amino-4-aryl-5-thiazole; thiapyrylium; benzopyrylium; pyrylium; 2-heterocyclylindole; 2-aryl-1,8-trimethyleneindole; carbazole; 2-aryl-1-alkylindole; 5-mercapto-tetrazole, indazole, piazine, thiuram disulfide, nitron, phenozine-N-oxides and N,N'-dialkyl-4,4'-bispyridinium.

3. System according to claim 1, wherein said electron withdrawing group or substituent is selected from the type consisting of acetyl-, benzosulfonyl-, benzoyl-, carbonyl-, acetoxy-, cyano-, nitro-, hydroxy-, chloro- and sulfonyl-.

4. System according to claim 1, wherein said silver bromoiodide tabular grains have silver iodide in an amount of at most 1 mole %, based on silver.

5. System according to claim 1, wherein said tabular grains have an average volume between 0.05 and 2 $\mu m^3$ and the aspect ratio is between 5 and 25.

6. System according to claim 1, wherein a silver content per coated side, expressed as an equivalent amount of silver nitrate, is from 5 up to 25 $g/m^2$.

7. Method for forming a radiographic image, comprising the steps of (1) exposing a system according to claim 1 to x- or γ-rays with an energy greater than or equal to 10 kVp in order to form a latent image in radiation-sensitive layers of the film material, and (2) developing the said latent image.

8. Method according to claim 7, wherein the step of developing the said latent image is performed in a developing bath containing ascorbic acid as a developing agent.

9. Method according to claim 7, said method comprising the steps of (1) exposing a system according to claim 1, wherein said radiographic material is fully forehardened, and (2) developing the latent image obtained by exposure in a developing bath without further hardening.

10. Method according to claim 8, said method comprising the steps of (1) exposing a system according to claim 1, wherein said radiographic material is fully forehardened, and (2) developing the latent image obtained by exposure in a developing bath without further hardening.

11. A personal electromagnetic radiation monitor wearable by a person in order to warn the person of a radiation hazard condition caused by electromagnetic radiation emanating from a source of electromagnetic radiation, said monitor essentially comprising a material used in the system of claim 1.

* * * * *